United States Patent [19]

Leppard et al.

[11] 4,268,593

[45] May 19, 1981

[54] RECORDING MATERIAL FOR COLOR PHOTOGRAPHY

[75] Inventors: David G. Leppard, Marly; Michael Rasberger, Riehen, both of Switzerland

[73] Assignee: Ciba-Geigy AG, Basel, Switzerland

[21] Appl. No.: 91,275

[22] Filed: Nov. 5, 1979

[30] Foreign Application Priority Data

Nov. 6, 1978 [CH] Switzerland ..... 11396/78

[51] Int. Cl.[3] ..... G03C 7/00

[52] U.S. Cl. ..... 430/17; 430/372; 430/512; 430/551

[58] Field of Search ..... 430/372, 551, 512, 17

[56] References Cited

U.S. PATENT DOCUMENTS 2,596,926 5/1952 Gunther et al. ..... 430/372

3,183,219 5/1965 Schuler ..... 430/512

FOREIGN PATENT DOCUMENTS 2126187 12/1971 Fed. Rep. of Germany ..... 430/551

2654058 6/1977 Fed. Rep. of Germany .

*Primary Examiner*—J. Travis Brown

*Attorney, Agent, or Firm*—Sprung, Felfe, Horn, Lynch & Kramer

[57] ABSTRACT

Recording material, for color photography, which contains at least one piperidine compound containing one or more alkyl-substituted phenol groups, as the light stabilizer, in at least one light-sensitive silver halide emulsion layer, one interlayer and/or one protective layer. Colored images which are obtained by imagewise exposure and development of this recording material for color photography display good stability towards the action of visible and ultraviolet light.

8 Claims, No Drawings

RECORDING MATERIAL FOR COLOR PHOTOGRAPHY

The present invention relates to a recording material, for colour photography, which contains at least one light stabiliser in at least one light-sensitive silver halide emulsion layer and/or in at least one of the conventional auxiliary layers.

In order to produce coloured photographic images, recording materials for colour photography, which at the same time contain colour couplers in light-sensitive silver halide emulsion layers, are, as is known, exposed and developed with an aromatic developer substance containing primary amino groups. The oxidised developer substance then reacts with the colour coupler with the formation of an image dye, the amount of the latter depending on the amount of incident light. In general, a light-sensitive photographic multi-layer material is used which consists of a red-sensitive layer, which contains the cyan coupler, a green-sensitive layer, which contains the magenta coupler, and a blue-sensitive layer, which, in turn, contains the yellow coupler. On colour developing, the corresponding dyes having the colours cyan, magenta and yellow then form.

Usually, phenols or α-naphthols are employed as cyan couplers, pyrazolones are employed as magenta couplers and acylacetylamides are employed as yellow couplers. Accordingly, the dyes formed after developing are indophenols, indamines or azomethines.

The fastness to light of these dyes and thus, also, the fastness to light of the resulting coloured photographic images, is, however, unsatisfactory, both towards ultraviolet light and towards visible light.

Therefore, processes have already been disclosed for the protection of the coloured photographic images against the particularly harmful effect of ultraviolet radiation (wavelength range of about 300 to 400 nm) by the incorporation of ultraviolet absorbers in the photographic materials (German Auslegeschrift No. 1,547,863).

In order to achieve adequate light stabilisation, however, relatively large amounts of the ultraviolet absorbers have to be employed and, as a rule, the consequence of this is that the thickness of the photographic layers into which the ultraviolet absorbers are incorporated has to be increased. Such a measure is, however, highly undesirable with regard to the photographic characteristics of the material. Effective protection against bleaching of coloured images by visible light is, moreover, not achieved by the use of the ultraviolet absorbers.

A further disadvantage of the use of relatively large amounts of ultraviolet absorbers is that large amounts of solvent are needed to obtain the desired state of fine division of these compounds in the aqueous binder emulsions. If concentrated solutions of the ultraviolet absorbers are employed, there is a danger that they will precipitate in an uncontrolled manner, i.e. not in the desired state of fine division, when they are incorporated in the binder emulsions and that, thus, uniform protection against ultraviolet radiation cannot be achieved.

The tendency of coloured images which are formed using couplers of the pyrazolone or phenol type to form colour fogs on storage is also not adequately prevented by the ultraviolet absorbers.

German Offenlegungsschriften Nos. 2,126,187 and 2,126,954 propose specific piperidine derivatives as compounds which are suitable for protecting coloured photographs against bleaching. The light stabilisation, which is said to be achieved not only against visible light but also against ultraviolet light, is, however, only slight and not able to meet the demands made.

The object of the present invention is, therefore, to provide a novel recording material, for colour photography, which contains more effective light stabilisers, both against visible light and against ultraviolet light, in order thus further to improve the fastness to light of the coloured images obtained from these photographic recording materials (to prevent bleaching of the dyes) and, moreover, to suppress the undesirable fogging.

It has now been found, surprisingly, that the said object can be achieved according to the invention by incorporating the compounds of the formula (1), if desired in combination with known ultraviolet absorbers, in relatively small amounts into recording materials for colour photography and thus obtaining an effective light stabilisation superior to that of the prior art.

The present invention therefore relates to a recording material, for colour photography, which contains at least one piperidine compound as the light stabiliser in at least one light-sensitive silver halide emulsion layer, one interlayer and/or one protective layer, wherein the piperidine compound has the formula (1)

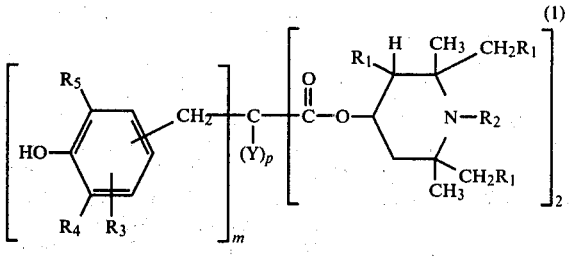

in which $R_1$ is hydrogen or alkyl having 1 to 4 carbon atoms, $R_2$ is alkyl or hydroxyalkyl, each having 1 to 12 carbon atoms, alkenyl or alkynyl having 3 or 4 carbon atoms, benzyl or $R_6CO$—, in which $R_6$ is hydrogen, alkyl having 1 to 12 carbon atoms, alkenyl having 2 or 3 carbon atoms, chloromethyl, cyclohexyl, benzyl or phenyl or phenylethyl, which are unsubstituted or substituted by two alkyl groups, each having 1 to 4 carbon atoms, and one hydroxyl group, $R_3$ is hydrogen or methyl, $R_4$ and $R_5$ are each alkyl having 1 to 5 carbon atoms or cycloalkyl having 5 to 8 carbon atoms and Y is hydrogen, alkyl having 1 to 12 carbon atoms or —$C_nH_{2n}COOR_7$, in which n is 0 or an integer from 1 to 10 and $R_7$ is hydrogen, alkyl having 1 to 18 carbon atoms, especially methyl or ethyl, or the radical of the formula (1a)

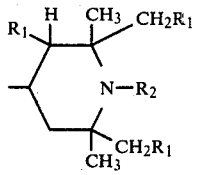

in which $R_1$ and $R_2$ are as defined, or Y is —$CH_2CH_2CN$ or —$NHCOR_8$, in which $R_8$ is methyl, ethyl, phenyl or benzyl, or Y is also cyano, benzyl or a radical of the formula

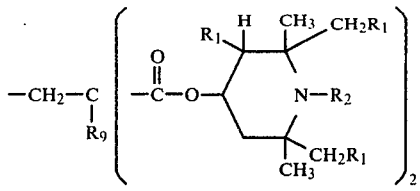

(1b)

in which $R_1$ and $R_2$ are as defined and $R_9$ is hydrogen or alkyl having 1 to 4 carbon atoms, especially methyl or ethyl, m is 1 or 2 and p is 1 or 0.

If desired, the light stabilisers can also be used in combination with conventional ultraviolet absorbers. The present invention also relates to a process for stabilising recording materials, for colour photography, by the incorporation of at least one light stabiliser of the formula (1), if desired in combination with an ultraviolet absorber, into at least one light-sensitive and/or auxiliary layer of the material, to a process for the production of coloured photographic images stabilised against the harmful action of light, by image-wise exposure and colour development of the said recording materials, and to the coloured photographic images obtained in this way.

In the compounds of the formula (1), $R_1$ is in each case alkyl having 1 to 4 carbon atoms, for example methyl, ethyl, n-propyl or n-butyl. Ethyl and in particular methyl are preferred.

As alkyl having 1 to 12 carbon atoms, $R_2$ is, as a rule, a primary alkyl group, such as those mentioned above, or also, for example, n-amyl, n-hexyl, n-octyl, n-nonyl, n-decyl or n-dodecyl. Radicals suitable as hydroxyalkyl $R_2$ are the analogous radicals.

As alkenyl or alkynyl having 3 or 4 carbon atoms, $R_2$ can be, for example, allyl, methallyl or propargyl.

In acyl ($R_6CO$—) $R_2$, $R_6$ can be hydrogen, alkyl having 1 to 12 carbon atoms [alkyl groups as mentioned above and also, if desired, isomeric (branched-chain) alkyl radicals], alkenyl having 2 or 3 carbon atoms, for example $CH_2{=}CH$—, $CH_2{=}C(CH_3)$— or $CH_3CH{=}CH$—, or also chloromethyl, cyclohexyl, benzyl or phenyl or phenylethyl which are unsubstituted or substituted by 2 alkyl groups, each having 1 to 4 carbon atoms, and one hydroxyl group.

$R_2$ is preferably alkyl or hydroxyalkyl, each having 1 to 4 carbon atoms, alkenyl or alkynyl having 3 or 4 carbon atoms, benzyl or also acyl, examples of which are formyl, acetyl, propionyl, acrylyl, methacrylyl, crotonyl, benzoyl or benzylcarbonyl.

$R_3$ is hydrogen or methyl. $R_4$ and $R_5$ are each alkyl having 1 to 5 carbon atoms, suitable radicals being the primary alkyl radicals already mentioned above and also secondary or tertiary alkyl groups, for example isopropyl, isobutyl or tert.-butyl. $R_4$ and $R_5$ are also cycloalkyl having 5 to 8 carbon atoms, for example, in particular, cyclopentyl and cyclohexyl. $R_4$ and $R_5$ are preferably alkyl having 1 to 4 carbon atoms, especially methyl and tert.-butyl.

The substituent Y, which is a substituent which can be present on the central carbon atom in the compounds of the formula (1), can be hydrogen or straightchain or branched alkyl having 1 to 12 carbon atoms, for example methyl, ethyl, propyl, iso-propyl, butyl, n-amyl, n-hexyl, n- and iso-heptyl, n-octyl, n-nonyl, n-decyl, n-undecyl or dodecyl and the corresponding isomers.

If Y is $—(CH_2)_qCOOR_7$ in which q is 0 or an integer from 1 to 10, $R_7$ can be hydrogen, methyl or ethyl. If Y is the radical $—NHCOR_8$, $R_8$ is methyl or ethyl, or also phenyl or benzyl; Y is also cyano, benzyl or a radical of the formulae (1a) or (1b), in which the substituents are as defined. The substituent $R_9$ in the formula (1b) is hydrogen, methyl or ethyl.

Preferred recording materials for colour photography are those which contain, as light stabilisers, at least one compound of the formula

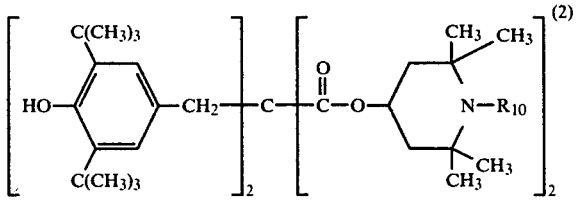

(2)

in which $R_{10}$ is methyl, ethyl, benzyl, acetyl, acrylyl, methacrylyl, crotonyl, allyl or propargyl.

Typical representatives of compounds of the formulae (1) and (2) are the following compounds

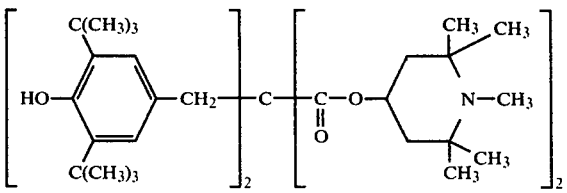

(3)

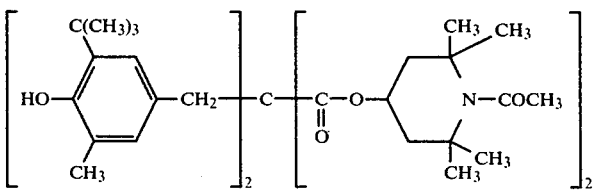

(4)

-continued
(5)
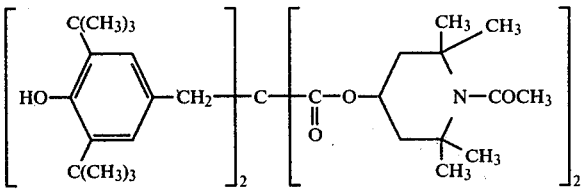
(6)
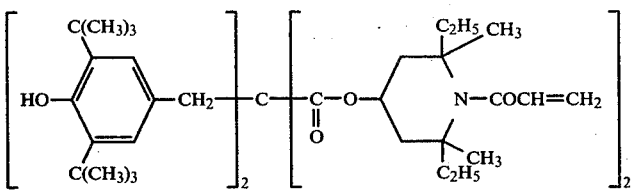
(7)
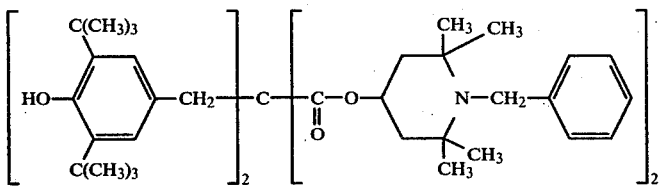
(8)
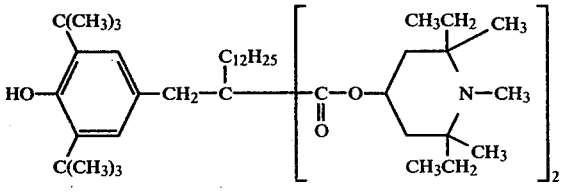
(9)
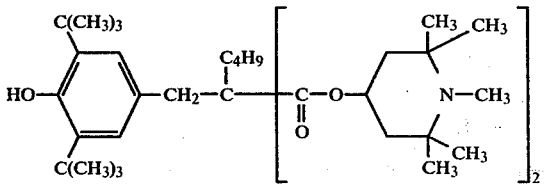
(10)
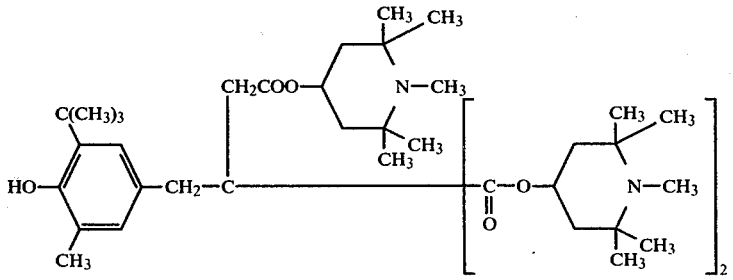
(11)
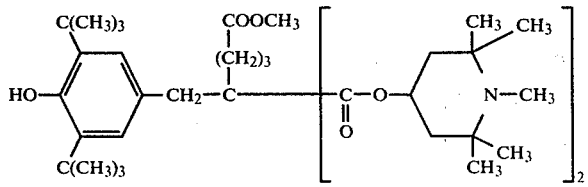

-continued
(12)
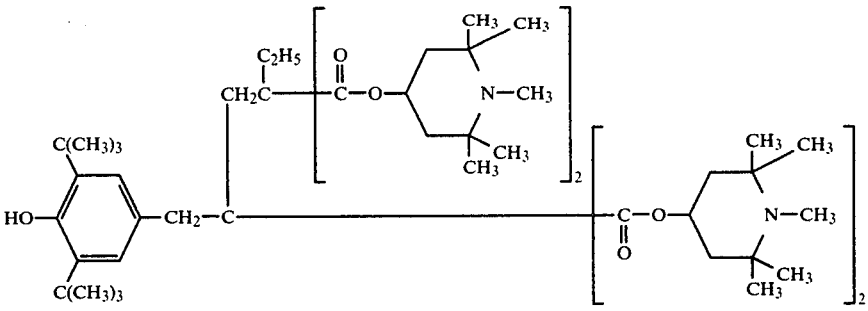
(13)
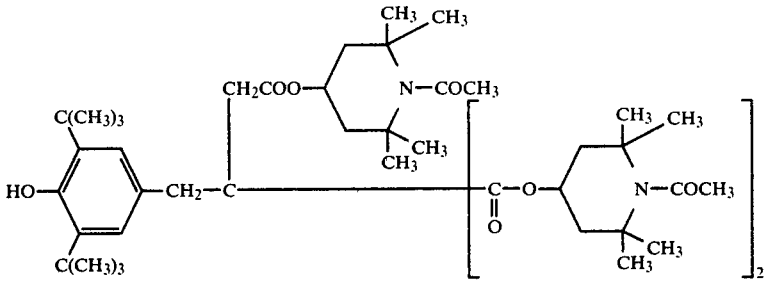
(14)
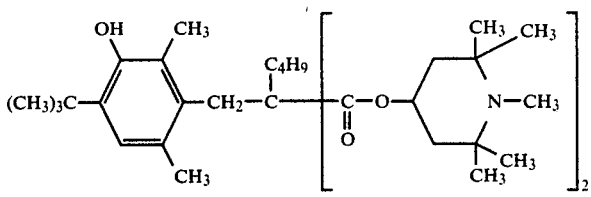
(15)
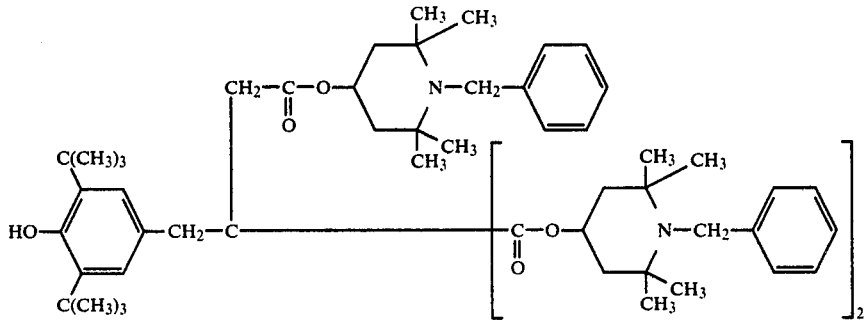
(16)
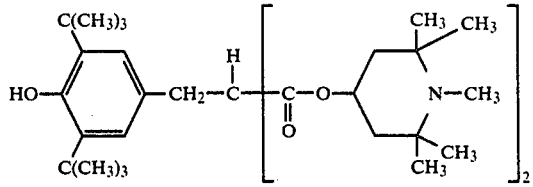
(17)
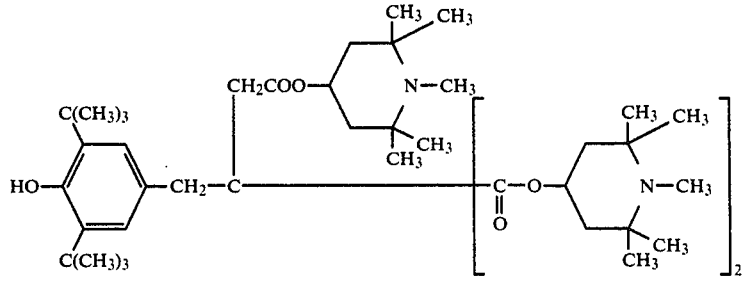

-continued
(18)
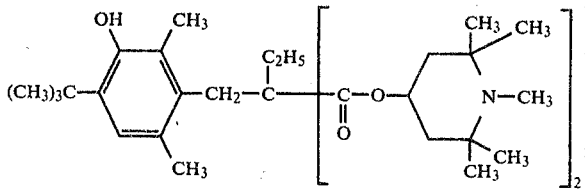
(19)
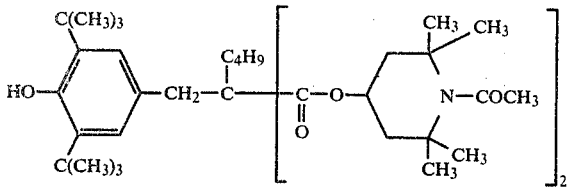
(20)
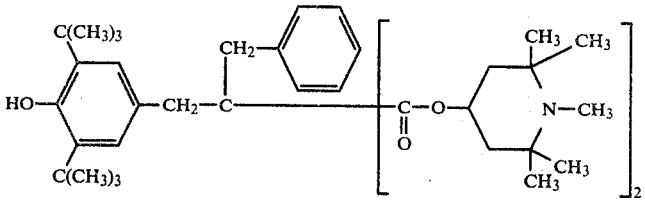
(21)
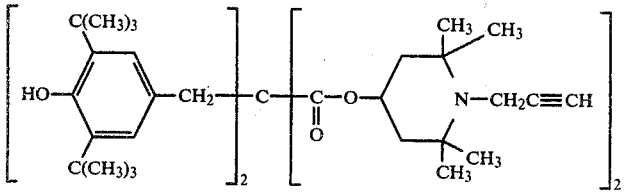
(22)
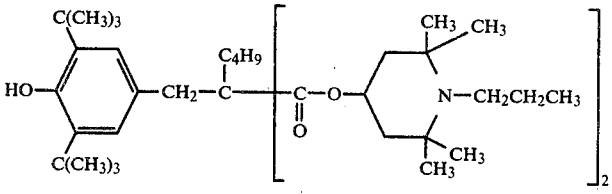
(23)
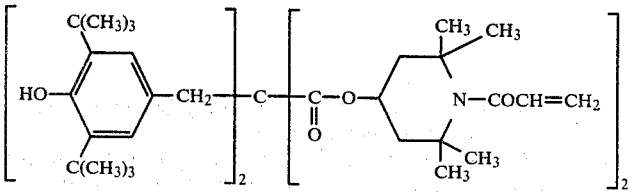
(24)
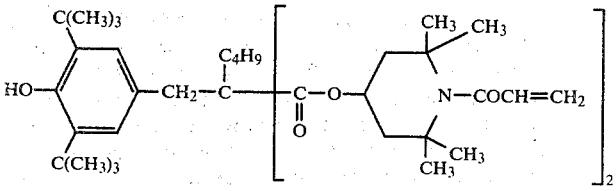
(25)
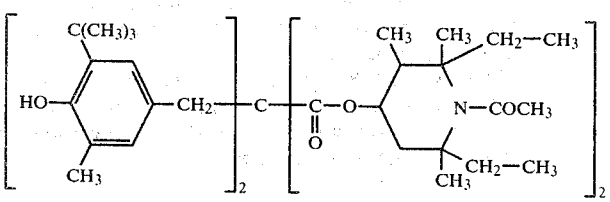

-continued (26)

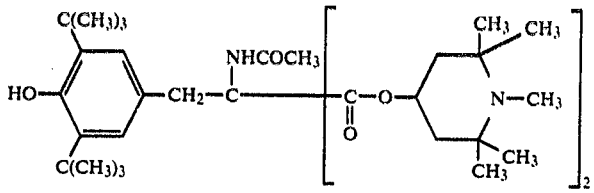

(27)

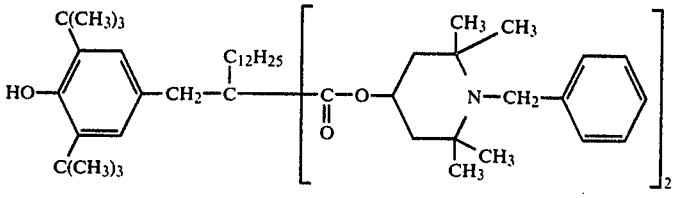

(28)

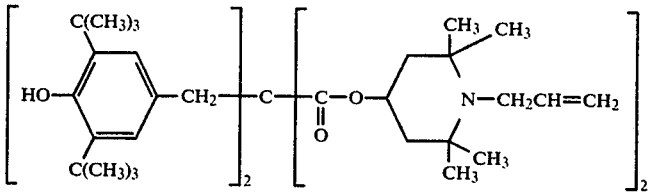

(29)

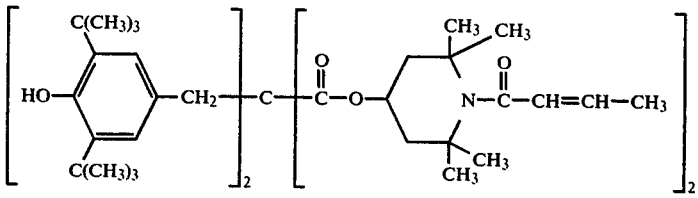

(30)

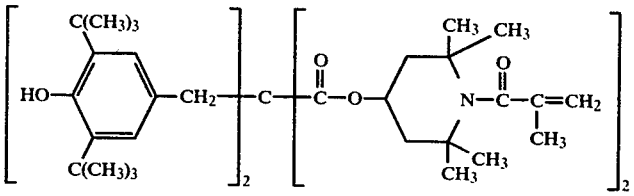

(31)

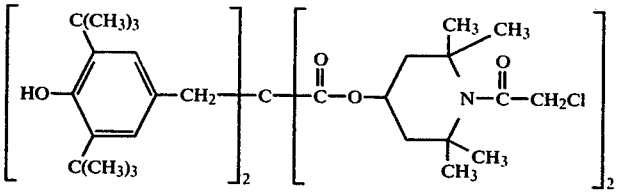

The compounds of the formulae (1) to (31) are known compounds which are described, for example, in German Offenlegungsschriften Nos. 2,456,364, 2,647,452, 2,654,058 and 2,656,769.

The compounds can be prepared by diverse methods and as a rule several reaction steps are necessary.

Starting materials for the first reaction step are, for example, malonic acid or one of its reactive derivatives, for example the dialkyl esters, and 4-hydroxy- or 4-amino-piperidines; the substituents ($R_2$) on the nitrogen atom of the piperidine ring can already be present in the molecule or can be introduced into the molecule in a subsequent N-alkylation or N-acylation step by conventional methods. Suitable alkylating and acylating agents are, for example alkyl halides, alkenyl halides, propargyl chloride, benzyl chloride or carboxylic acid chlorides and these are preferably reacted with the piperidine derivative in the presence of molar amounts of a base. Hydroxyalkyl radicals are introduced into the molecule by reaction with epoxides, for example ethylene oxide or propylene oxide.

As the next step either first the hydroxybenzyl substituent and then the substituent Y or-preferably-first the substituent Y and then the hydroxybenzyl group can be introduced into the compounds of the formula (1).

The introduction of the hydroxybenzyl group can be effected by reaction with an alkyl-substituted hydroxybenzyl dithiocarbamate of the formula HO-benzyl-S-CS-N(R″)$_2$, in which R″ is an alkyl group having 1 to 5 carbon atoms, or the two R″ groups together with the nitrogen are a morpholine, pyrrolidine or piperidine ring. Dithiocarbamates of this type are obtainable by reacting a phenol with formaldehyde, carbon disulfide and a secondary amine.

If the substituent Y is present in the compounds of the formulae (1) and (2), it can be introduced into the molecule by the known methods for the C-alkylation of activated methylene compounds.

The compounds of the formulae (1) and (2) are virtually insoluble in water and are therefore dissolved in a low-boiling organic solvent, such as methyl acetate, ethyl acetate, carbon tetrachloride, chloroform, methanol, ethanol, n-butanol, dioxan, acetone or benzene, a high-boiling organic solvent, such as tricresyl phosphate, dimethylformamide, dimethylsulfoxide, di-n-butyl phthalate or ethyl N-diphenylcarbamate, or a solvent mixture consisting of the abovementioned low-boiling and high-boiling organic solvents; the resulting solution is added to a solution of a protective colloid, such as, in particular, an aqueous gelatine solution, and dispersed by means of a colloid mill or a homogeniser or by the use of ultrasonic sound.

The dispersions thus obtained are then used to produce the layers of recording materials for colour photography (for example film, paper or silver dye-bleach materials). These layers can be, for example, interlayers or protective layers, but especially light-sensitive (blue-sensitive and red-sensitive) silver halide emulsion layers, in which the cyan, magenta and yellow dyes are formed from the corresponding colour couplers when the exposed recording material is developed.

If ultraviolet absorbers are also used, these are present in the same layers, but preferably in the inter-layers or protective layers.

If desired, the light stabiliser can also be applied in the treatment baths which are used after colour developing, for example in fixing and/or washing baths, but a certain solubility of the compounds of the formula (1) in alcohols (methanol/ethanol), aqueous alkali and/or water is necessary for this. If the diffusion transfer method is employed, the light stabiliser can be incorporated not only in the conventional photographic emulsion layers but also in a receiving layer.

The cyan, magenta and yellow couplers employed can be any such couplers which are used to form the said dyes and thus the coloured images. They can, for example, be dissolved in alkaline solution or in a high-boiling organic solvent, in which case these solutions are then dispersed in an aqueous gelatine solution and incorporated in a photographic silver halide emulsion.

The silver halide emulsions preferably contain gelatine as the binder and, if desired, this can be mixed with other high molecular weight natural or synthetic compounds.

The silver halide emulsions can, for example, be silver bromide, silver chloride or silver iodide emulsions or those emulsions which contain a mixture of silver halides, such as silver bromide/iodide or silver chloride/bromide emulsions.

The emulsions can be chemically sensitised and they can also contain conventional organic stabilisers and anti-fogging agents, as well as conventional plasticisers, for example glycerol. The emulsions can also be hardened with the hardeners customary for gelatine. Furthermore, the emulsions can contain conventional coating aids. The emulsions can be applied to conventional layer supports for recording material for photography.

The conventional developing baths can be employed for developing the recording material for colour photography. These baths as a rule contain a developer substance of the p-phenylenediamine type, a development retarder, such as potassium bromide, an antioxidant, such as sodium sulfite, and a base, for example an alkali metal hydroxide or alkali metal carbonate. Furthermore, the developing baths can contain a conventional anti-fogging agent and complexing agents.

The amount of light stabiliser, if desired in combination with a conventional ultraviolet absorber, can vary within wide limits and is approximately in the range of 1 to 500 mg, preferably 1 to 300 and in particular 200 mg per $m^2$ of the layer in which it or they is or are incorporated.

The ultraviolet absorber can be present together with the light stabiliser in one layer or can also be in an adjacent layer. The weight ratio of a conventional ultraviolet absorber to the light stabiliser of the formula (1) is about (5–10):1 and the molar ratio is about (10–20):1. Examples of ultraviolet absorbers are compounds of the benzophenone, acrylonitrile, thiazolidone, benztriazole, oxazole, thiazole and imidazole type.

The coloured images obtained with the recording material according to the invention, by exposure and developing, display a markedly improved fastness to light, towards both visible and ultraviolet light. The compounds of the formula (1) are virtually colourless, so that there is no discoloration of the images; moreover, they are readily compatible with the conventional photographic additives present in the individual layers; because they are highly effective, the amount in which they are employed can be reduced and this prevents them precipitating or crystallising out when they are incorporated in the form of an organic solution into the aqueous binder emulsions which are used to produce photographic layers. The light stabilisers have no adverse effect on the individual processing steps which are necessary after exposure of the recording material for photography in order to produce the coloured images. Furthermore, the so-called pressure fogging which frequently arises in the case of blue-sensitive emulsions can be largely suppressed. This can arise, for example, if photographic materials (silver halide emulsion layers which are on a support consisting of natural or synthetic materials) are subjected to mechanical stress, for example turning, bending or rubbing, during production or during the treatment prior to developing. (T. H. James, The Theory of the Photographic Process, 4th edition, Macmillan, New York, N.Y. 1977, page 23 et seq., page 166 et seq.)

In the following examples parts and percentages are by weight unless stated otherwise.

EXAMPLE 1

0.1 mmol of the yellow coupler of the formula

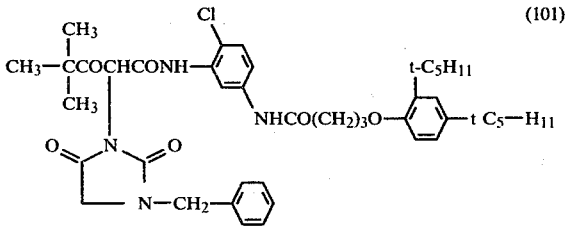

(101)

and 0.04 mmol of the compound of the formula (3) [and also of the compounds of the formulae (5), (7) and (23)] are dissolved in 2.0 ml of tricresyl phosphate/ethyl acetate (1:79). 7.0 ml of 6% gelatine solution, 0.5 ml of an 8% solution of the wetting agent of the formula

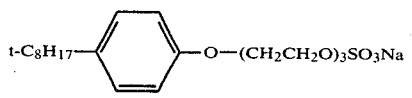
(102)

in isopropanol/water (3:4) and 0.5 ml of water are added and the mixture is then emulsified for 5 minutes with the aid of an ultrasonic device with an output of 100 Watts. 2.5 ml of the coupler/additive emulsion, freshly exposed to ultrasonic waves, 0.8 ml of silver bromide emulsion containing 2.8% of silver, 0.7 ml of a 1% aqueous solution of the hardener of the formula

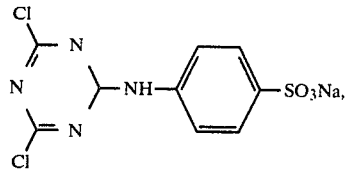
(103)

0.4 ml of 1.5% aqueous gelatine solution and 4.0 ml of water are mixed together, the pH value is adjusted to 6.5 and the mixture is coated, at 40° C., onto a subbed glass plate 13×18 cm in size. After the layer has solidified at 10° C., the plate is dried in a circulating air drying cabinet at room temperature.

PROCESSING

A strip of the coated glass plate cut to a size of 4.0 cm×6.5 cm is exposed, at 500 lux, under a step wedge for 6 seconds and then processed at 32.8° C. (±0.3° C.) as follows:

| | | |
|---|---|---|
| 1. | Developing bath | 3.5 minutes |
| 2. | Bleach-fixing bath | 1.5 minutes |
| 3. | Washing | 3.0 minutes |
| 4. | Drying | 1.0 minutes |

The developing bath has the following composition:

| | | |
|---|---|---|
| 4-amino-3-methyl-N-ethyl-N-[β-(methyl-sulfonamido)-ethyl]-aniline. $1\frac{1}{2}$ $H_2SO_4$ . $H_2O$ | 4.85 | (g/l) |
| potassium bromide | 0.6 | |
| potassium carbonate | 32.0 | |
| lithium sulfate | 1.8 | |
| potassium sulfite | 2.0 | |
| hydroxylamine sulfite | 3.9 | |
| ethylene glycol | 21.3 | |
| benzyl alcohol | 15.1 | |
| water | to make up to 1 litre | |

The pH value is 10.1

The bleach-fixing bath used is a conventional bath which has, for example, the following composition:

| | | |
|---|---|---|
| ammonium thiosulfate (80% solution) | 200 | (g/l) |
| sodium sulfite (anhydrous) | 15 | |
| sodium carbonate (anhydrous) | 2.5 | |
| ethylenediaminetetraacetic acid, sodium salt | 2 | |
| ethylenediaminetetraacetic acid, sodium/iron-III salt | 50 | |
| water to make up to | 1 | litre |

After washing and drying, a clear, sharp yellow wedge with an absorption maximum at 445 nm and a maximum density of 1.34 is obtained.

The step wedge thus obtained is irradiated in an Atlas apparatus (2,500 Watt lamp) with, in each case, 10,000 Langley units, with and without an ultraviolet filter (Kodak filter 2C). In each case, an analogously produced step wedge which contains no additive and also further step wedges which have been produced using the compounds of the formulae (104) and (107) to (110) are used for comparison.

In all cases, the residual optical density (OD) is measured in % of the initial density. Table 1 gives the results.

Comparison compounds:

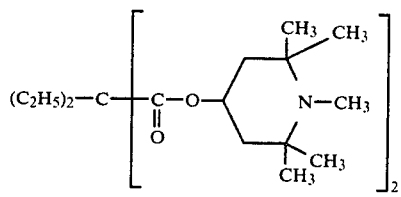
(104)

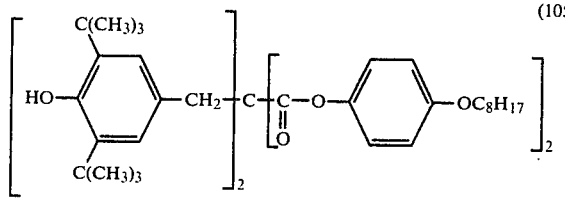
(105)

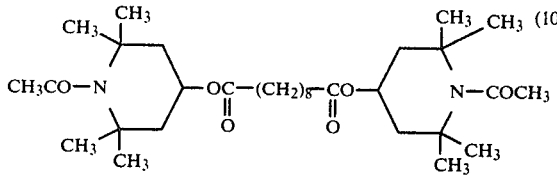
(106)

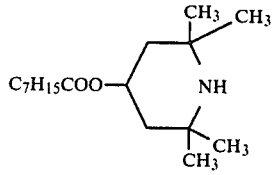
(107)

(Example 4—German Offenlegungsschrift No. 2,126,954)

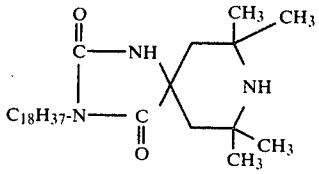
(108)

(Example 49—German Offenlegungsschrift No. 2,126,187)

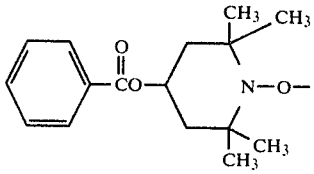
(109)

-continued

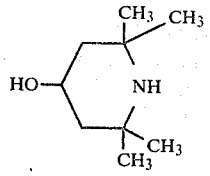

(110)

(Example 34—German Offenlegungsschrift No. 2,126,954)

TABLE 1

| Light stabiliser of the formula | % OD (without UV filter) | % OD (with UV filter) |
|---|---|---|
| without a light stabiliser | 65 | 89 |
| (3) | 81 | 89 |
| (5) | 84 | 94 |
| (7) | 80 | 93 |
| (23) | 82 | 95 |
| Comparison compounds: | | |
| (104) | 63 | 87 |
| (107) | 63 | 86 |
| (108) | 68 | 88 |
| (109) | 77 | 86[1] |
| (110) | 64 | 86 |

[1]extensive fogging

The data show the good protection of the photographic material against the harmful influence of light, which can be achieved using the light stabilisers employed according to the invention. The effects are markedly improved compared with those which can be achieved using known light stabilisers already in use in photographic materials. Good results are likewise obtained with the compounds of the formulae (4), (6), (8) to (22) and (24) to (31).

EXAMPLE 2

0.4 mmol of the cyan coupler of the formula

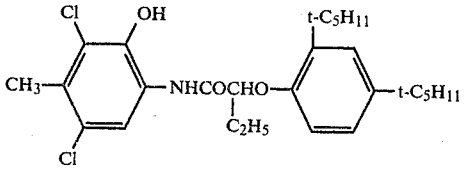

(111)

and 0.02 mmol of the additive of the formula (5) [and also of the additives of the formula (13) and (23)] are dissolved in 2.0 ml of tricresyl phosphate/ethyl acetate (1:159). 7.0 ml of 6% gelatine solution, 0.5 ml of an 8% solution of the wetting agent of the formula (102) in isopropanol/water (3:4) and 0.5 ml of water are added; the mixture is then emulsified for 5 minutes with the aid of an ultrasonic device with an output of 100 Watts. 2.5 ml of the coupler/additive emulsion, freshly exposed to ultrasonic waves, 0.4 ml of silver bromide emulsion containing 2.8% of silver, 0.7 ml of a 1% aqueous solution of the hardener of the formula (103), 0.4 ml of 1.5% aqueous gelatine solution and 4.0 ml of water are mixed together, the pH value is adjusted to 6.5 and the mixture is coated, at 40° C., onto a subbed glass plate 13×18 cm in size. After the layer has solidified at 10° C., the plate is dried in a circulating air drying cabinet at room temperature.

PROCESSING

A strip of the coated glass plate cut to a size of 4.0 cm×6.5 cm is exposed, at 500 lux, under a step wedge for 6 seconds and then processed at 32.8° C. (±0.3° C.) as described in Example 1.

A clear, sharp, cyan coloured step wedge with an absorption maximum at 653 nm and a maximum density of 1.10 is obtained.

The step wedge and analogously produced step wedges which have been prepared using the compounds (105) to (110) are exposed, and measured, as described in Example 1. Table 2 gives the results.

TABLE 2

| Light stabiliser of the formula | % OD (without UV filter) | % OD (with UV filter) |
|---|---|---|
| without a light stabiliser | 78 | 84 |
| (5) | 83 | 89 |
| (13) | 87 | 89 |
| (23) | 82 | 89 |
| Comparison compounds: | | |
| (105) | 75 | 87 |
| (106) | 80 | 86 |
| (107) | 41 | 50 |
| (108) | 48 | 56 |
| (109) | — | —[1] |
| (110) | 76 | 82 |

[1]Dye formation does not take place.

Good results are likewise obtained with the compounds of the formulae (3), (4), (6) to (12), (14) to (22) and (24) to (31).

EXAMPLE 3

$3.5\times10^{-3}$ mols of the yellow coupler of the formula

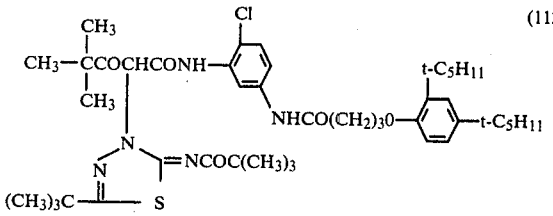

(112)

(German Offenlegungsschrift No. 2,716,204) are dissolved in 10 ml of ethyl acetate and 1.5 g of tricresyl phosphate are added. This solution is emulsified in 100 ml of 4% gelatine solution, which contains 0.3 g of an alkylarylsulphonate emulsifier, with the aid of an ultrasonic device. The ethyl acetate is then distilled off. A light-sensitive silver chloride/bromide dispersion (average particle size of the silver halide crystals about 1 μm), which has been chemically sensitised in the conventional manner, is then mixed into this emulsion at about 40° C.

4 $m^2$ of a polyethylene-laminated paper support are coated with this mixture and then with a gelatine solution, containing a hardener, as the protective layer. A two-layer photographic material is thus obtained and the sensitivity of this material to pressure or bending is determined. For this purpose, the dried photographic material is drawn, under a tension of about 1 kg, over a rounded edge with a radius of curvature of about 0.7 mm at an angle of about 90°.

This sample, parallel with a blank sample, is exposed through an exposure wedge, processed by conventional processes and evaluated densitometrically ($\Delta D_{min}$ = so-called pressure fog). The increase in the minimum density compared with that of the blank sample is a measure of the bending stress.

EXAMPLE 4

Gelatine solutions are prepared as in Example 1, except that the light stabilisers of the formulae (23) (according to the invention) and (105) and (106) (comparison) and the yellow coupler of the formula (113)

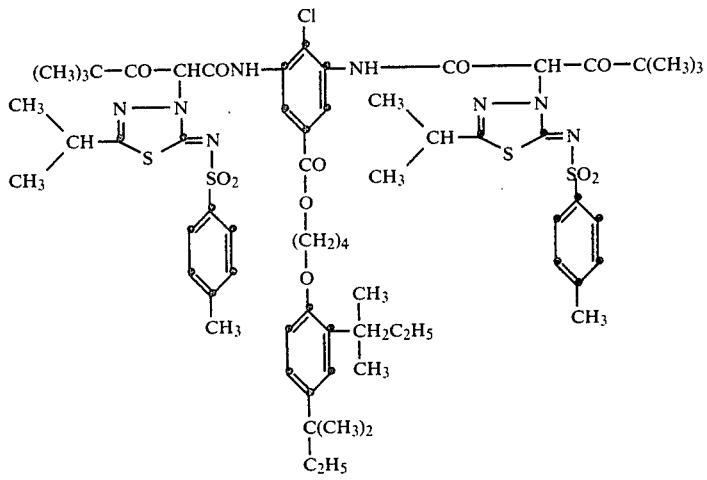

or the formula (114)

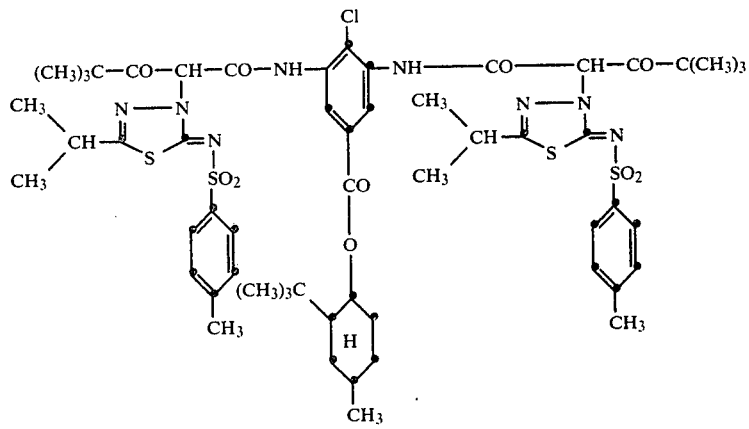

(German Offenlegungsschrift No. 2,757,380) are used.

The light stabilisers and the yellow couplers are employed in a molar ratio of 1:1.

The preparation of the coated glass plates, the exposure and photographic processing and also the test to determine the fastness to light are carried out as in Example 1. The test to determine the fastness to light is carried out with an irradiation of 15,000 Langley units.

In both cases, the residual optical density (OD) is measured. Table 4 gives the results in % of the initial density. A markedly improved light stabilisation is achieved with the compounds employed according to the invention.

Further photographic materials, which, in addition to the colour coupler, contain light stabilisers in amounts of $0.7\times10^{-3}$ mol and $1.4\times10^{-3}$ mols per $m^2$, in each case dissolved in ethyl acetate, are produced analogously. The values determined in these tests for the pressure fog are listed in Table 3 below.

TABLE 3

| Light stabiliser of the formula | Amount ($10^{-4}$ mols/$m^2$) | Pressure fog ($\Delta D_{min}$) |
|---|---|---|
| without a light stabiliser | 0 | 0.13 |
| (3) | 1.7 | 0.04 |
| | 3.4 | 0.02 |
| (5) | 1.7 | 0.04 |
| | 3.4 | 0.02 |
| (7) | 1.7 | 0.03 |
| | 3.4 | 0.01 |
| (21) | 1.7 | 0.04 |
| | 3.4 | 0.01 |
| (28) | 1.7 | 0.04 |
| | 3.4 | 0.02 |

TABLE 4

| Yellow coupler of the formula | Light stabiliser of the formula | % OD (without UV filter) | % OD (with UV filter) |
|---|---|---|---|
| (113) | — | 23 | 85 |
| | (23) | 72 | 96 |
| | (105) | 30 | 94 |
| | (106) | 42 | 89 |
| (114) | — | 30 | 84 |
| | (23) | 75 | 96 |
| | (105) | 53 | 94 |

TABLE 4-continued

| Yellow coupler of the formula | Light stabiliser of the formula | % OD (without UV filter) | % OD (with UV filter) |
|---|---|---|---|
| | (106) | 38 | 88 |

What is claimed is:

1. A recording material, for colour photography, which contains at least one piperidine compound as the light stabiliser in at least one light-sensitive silver halide emulsion layer, one interlayer and/or one protective layer, wherein the piperidine compound has the formula

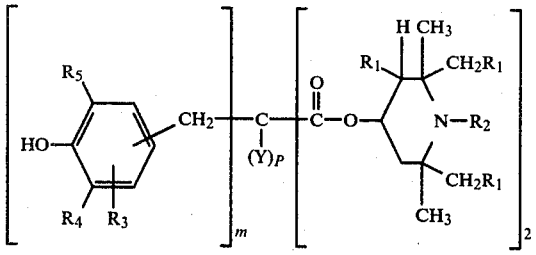

in which $R_1$ is hydrogen or alkyl having 1 to 4 carbon atoms, $R_2$ is alkyl or hydroxyalkyl, each having 1 to 12 carbon atoms, alkenyl or alkynyl having 3 or 4 carbon atoms, benzyl or $R_6CO$—, in which $R_6$ is hydrogen, alkyl having 1 to 12 carbon atoms, alkenyl having 2 or 3 carbon atoms, chloromethyl, cyclohexyl, benzyl or phenyl or phenylethyl, which are unsubstituted or substituted by two alkyl groups, each having 1 to 4 carbon atoms, and one hydroxyl group, $R_3$ is hydrogen or methyl, $R_4$ and $R_5$ are each alkyl having 1 to 5 carbon atoms or cycloalkyl having 5 to 8 carbon atoms and Y is hydrogen, alkyl having 1 to 12 carbon atoms or —$C_nH_{2n}COOR_7$, in which n is 0 or an integer from 1 to 10 and $R_7$ is hydrogen, alkyl having 1 to 18 carbon atoms, preferably methyl or ethyl, or the radical of the formula

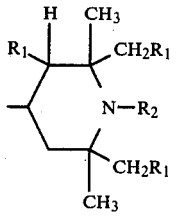

or Y is —$CH_2CH_2CN$ or —$NHCOR_8$, in which $R_8$ is methyl, ethyl, phenyl or benzyl, or Y is also cyano, benzyl or the radical of the formula

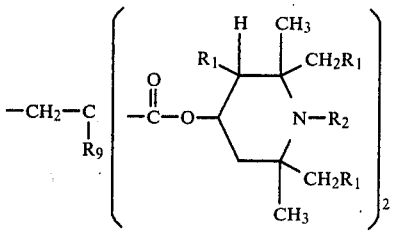

in which $R_1$ and $R_2$ are as defined and $R_9$ is hydrogen or alkyl having 1 to 4 carbon atoms, m is 1 or 2 and p is 1 or 0.

2. A recording material, for colour photography, according to claim 1, wherein the piperidine compound has the formula

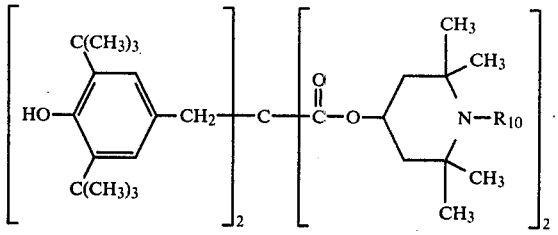

in which $R_{10}$ is methyl, ethyl, benzyl, acetyl, acrylyl, methacrylyl, crotonyl, allyl or propargyl.

3. A recording material, for colour photography, according to either of claims 1 and 2, which contains the light stabilisers in combination with ultraviolet absorbers.

4. A recording material, for colour photography, according to claim 3, wherein the ultraviolet absorbers are compounds of the benzophenone, acrylonitrile, thiazolidone, benztriazole, oxazole, thiazole or imidazole type.

5. A recording material, for colour photography, according to any one of claims 1 to 4, which contains 1 to 500 mg of the light stabiliser and, if desired, of the ultraviolet absorber per $m^2$ of the layer in which it or they is or are incorporated.

6. A process for stabilising recording materials, for colour photography, which contain at least one light-sensitive silver halide emulsion layer, against the harmful action of light, which comprises incorporating 1 to 500 mg, per $m^2$ of layer, of at least one light stabiliser according to claim 1, if desired in combination with ultraviolet absorbers, into at least one silver halide emulsion layer, one interlayer and/or one protective layer.

7. A process for the production of coloured photographic images by image-wise exposure and colour development of a recording material, for colour photography, according to any one of claims 1 to 5.

8. The coloured photographic images obtained by the process according to claim 7.

* * * * *